United States Patent [19]

Jackson et al.

[11] Patent Number: 4,669,752

[45] Date of Patent: Jun. 2, 1987

[54] CROSS COUNTRY SKI POLE WITH INTERCHANGEABLE BASKETS

[75] Inventors: Randy D. Jackson, 106 Knox St., Millinocket, Me. 04462; Mary F. Woodman, Auburn; Catherine J. Small, Hallowell, both of Me.

[73] Assignee: Randy D. Jackson, Millinocket, Me.

[21] Appl. No.: 849,682

[22] Filed: Apr. 9, 1986

[51] Int. Cl.[4] ..... A63C 11/24

[52] U.S. Cl. ..... 280/824

[58] Field of Search ..... 280/819, 823, 824

[56] References Cited

U.S. PATENT DOCUMENTS

| | | | |
|---|---|---|---|
| 2,465,205 | 12/1948 | Magder | 280/11.37 |
| 2,721,084 | 10/1955 | Weiss | 280/11.37 |
| 2,741,485 | 4/1956 | Storm et al. | 280/11.37 |
| 4,014,559 | 3/1977 | Funke | 280/824 |
| 4,057,261 | 11/1977 | Koblick | 280/11.37 |
| 4,221,392 | 9/1980 | Aho | 280/824 |
| 4,336,949 | 6/1982 | Aho | 280/824 |
| 4,385,776 | 5/1983 | Pronzati | 280/824 |

FOREIGN PATENT DOCUMENTS 808546 7/1951 Fed. Rep. of Germany .

*Primary Examiner*—John J. Love
*Assistant Examiner*—Richard Camby
*Attorney, Agent, or Firm*—Kenyon and Kenyon

[57] ABSTRACT

A cross country ski pole assembly having an end piece for interchangeably mounting baskets at different axial locations for use in touring, deep powder, and racing. The end piece has a stepped construction with an upper cylindrical section of larger diameter than a lower cylindrical section. General touring and deep powder baskets are provided with bores that fit the upper section; racing baskets have bores that fit the lower section.

15 Claims, 10 Drawing Figures

CROSS COUNTRY SKI POLE WITH INTERCHANGEABLE BASKETS

BACKGROUND OF THE INVENTION

1. Field of Invention

This invention pertains to cross country ski poles having replaceable and positionable baskets, and particularly to a ski pole provided with different baskets, such as those for general touring, deep powder skiing or racing, that may be interchangeably attached to the ski pole at an appropriate distance from the tip of the pole.

2. Related Art

Cross country skiing is a diverse winter activity which is pursued by novices and experts. A skier may ski both as a competitive and a recreational activity. People learning to ski may explore trails where the tracks have already been made by other skiers. This allows skiers to concentrate on improving their skills. More advanced skiers may prefer to explore areas where the trails have not been blazed. Skilled skiers may enter cross country ski competitions, where the tracks are carefully groomed.

As skiers' interests and skills develop, they typically purchase equipment that is particularly suited for specific ski conditions. For example, there are types of ski poles designed specifically for planting in the deep powder of off-trail skiing, the packed snow of a racetrack, or the snow of established trails. The first set of poles a skier buys is often part of a general touring package which includes skis, bindings, boots, and poles. These poles are designed to be all-purpose poles, but are best suited for general touring in average snow conditions. For off-trail skiing in deeper snow, special deep powder poles have been designed that work more effectively. Alternatively, a special pole exists for planting in the packed snow conditions of a racetrack. Major differences between these types of ski poles include the design and location of the baskets. The purchase of each set of poles represents a cost to the skier, and for the skier interested in pursuing different types of cross country skiing, the purchase of all of this special equipment is expensive.

There have been many previous attempts to design more versatile ski poles. Some have had numerous removable parts, each subject to failure or loss in the snow. U.S. Pat. No. 2,721,084 is an example of such a design. Other designs provide detachable baskets to permit a ski pole to be used for other purposes. German Patentschrift No. 808,546 describes a twist lock and unlock mechanism for mounting a basket on a ski pole, thereby allowing the ski pole to be used alternatively as a poker. U.S. Pat. No. 4,221,392 adds a clip-on element to a ski pole basket to increase the area of the basket for use in deep powder snow. U.S. Pat. Nos. 4,385,776, 4,336,949, and 2,741,485 show different attachment mechanisms for releasably mounting baskets at one location of a ski pole. These designs do not allow for substitution of different size baskets to be located at different distances from the tip of the pole.

SUMMARY OF THE INVENTION

Accordingly, an object of this invention is to improve the versatility of ski poles to enable skiers to better enjoy alternate types of cross country skiing without incurring unnecessary expense or inconvenience. An additional object is to provide a ski pole with different sizes of interchangeable baskets which can be positioned at respective optimum distances from the pole tip. A further object is to provide a mutual fastening device which is easy and quick to manipulate, even in subzero conditions, for installing and removing a ski pole basket. Still another object is to provide a locking arrangement for interchangeable ski pole baskets that is strong yet light in weight.

The above and other objects are achieved by having interchangeable and positionable baskets for cross country ski poles. The preferred embodiment of this invention includes a plastic end piece for the lower end of a ski pole shaft, the end piece being formed with a metal tip and an axially spaced series of basket positioning and locking means between the tip and pole. This allows a set of poles to be paired with sets of different baskets which mate with the appropriate positioning and locking means to locate the baskets at the appropriate distance from the tip of the pole. One set of baskets may be of the general touring type, one set may have a larger surface area to be more effective in deeper snow, and another set may be a smaller, more streamlined type for racing.

DETAILED DESCRIPTION OF THE PREFERRED EMBODIMENT

The preferred embodiment of an interchangeable basket assembly for a cross country ski pole according to the present invention includes an end piece and at least one of a set of three different baskets for selectively mounting at one of at least two axially spaced locations on the end piece.

Figure 1:
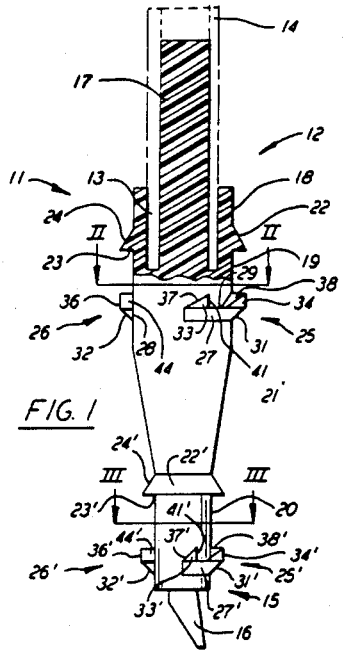
FIG. 1 is a side view, partly in section, illustrating a pole with an attached end piece according to the present invention.
Figure 2:
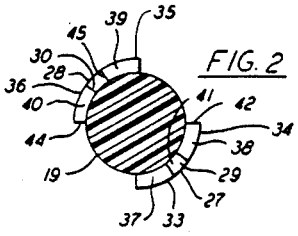
FIG. 2 is a cross-sectional view taken along the line II—II in FIG. 1.
Figure 3:
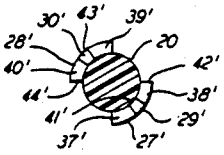
FIG. 3 is a cross-sectional view taken along the line III—III in FIG. 1.

With reference to FIGS. 1-3, an end piece 11 is formed with an upper end 12 having means for connecting the end piece to a lower end 13 of a conventional cross country ski pole shaft 14 and with a lower end 15 carrying a metal tip 16. End piece 11 may be made of any suitable material having the necessary strength and that is easily formed by casting or injection molding. Although the end piece could be metal, such as an aluminum, magnesium, or zinc alloy, the end piece preferably is made of an injection moldable high strength plastic. A particularly suitable material is a nylon reinforced plastic, such as is sold by DuPont under the trademark "Zytel STA01". This material is strong and rigid when formed in relatively large cross section, is tough and strong, and retains its physical properties well in low temperatures as encountered in cross country skiing.

The shape of end piece 11 is basically cylindrical, with a longitudinal axis coinciding with the longitudinal axis of the ski pole shaft 14. The means for connecting the upper end of the end piece to the ski pole shaft includes a central stud 17, the lower portion of which is sorrounded by a radially spaced annular wall 18. The stud fits closely inside the hollow shaft of the ski pole, and the space between the stud 17 and the surrounding wall 18 forms a socket for snugly receiving the lower end of the shaft 14. The end piece is secured to the shaft, which is preferably made of glass fiber reinforced plastic, by conventional means such as an epoxy resin.

The length of the end piece 11 is subdivided into a cylindrical upper large diameter section 19, a cylindrical lower small diameter section 20, and an intermediate tapered transition section 21 joining the upper and lower sections.

The upper section 19 is provided with an upper means for axially locating a basket on the end piece, the upper locating means being in the form of a circumferential lip or flange 22. Flange 22 has a flat annular surface 23 facing toward the lower or tip end of the end piece. This surface serves as an abutment stop for the upper face of a basket, as will be explained in more detail below. Flange 22 also preferably has a frustoconical face 24 that extends from the outer edge of the annular surface 23 inwardly to merge with the outer circumference of the upper section. The resulting triangular cross section provides stiffness to the flange while presenting a smooth profile to minimize possible packing of snow against the flange.

Spaced axially below the upper locating flange is an upper means for releasably locking a basket on the upper section. The upper locking means is in the form of two diametrically opposed keys 25, 26, the keys including ledges 27, 28 having triangular cross sections like that of flange 22 with flat faces 29, 30 and frustoconical surfaces 31, 32, respectively. The angular extent of each ledge occupies approximately a quadrant, and the flat faces 29, 30 are opposed to the flat surface 23 of the axial locating flange 22.

On each flat face 29, 30 are two ramps 33, 34 and 35, 36, respectively. The ramps have sloping faces 37, 38 and 39, 40 and axially extending walls 41, 42 and 43, 44. Each ramp faces the same direction, so that the ramps appear as two sets of two ratchet teeth each when viewed radially.

The lower cylindrical section 20 of end piece 11 is provided with lower means for axially positioning and lower means for releasably locking a basket. The design of the lower axial positioning and releasable locking means is identical to that of the upper axial positioning and releasable locking means, and the elements of the lower axial positioning means and the lower releasable locking means are identified by the same reference numerals as the upper means, but with a prime.

Figure 4:
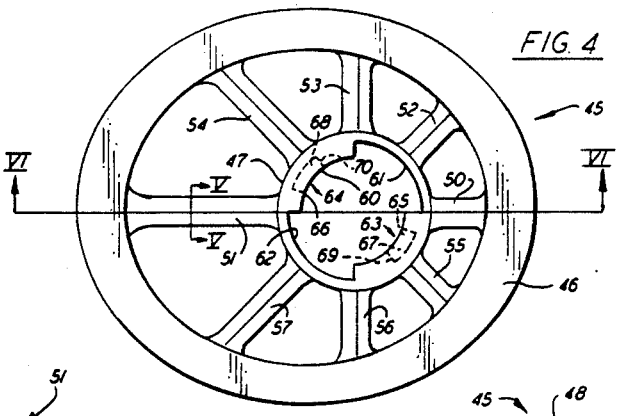
FIG. 4 is a view of a touring basket according to the present invention.
Figure 5:
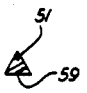
FIG. 5 is a cross-sectional view of a spoke of the touring basket taken along the line V—V of FIG. 4.
Figure 6:
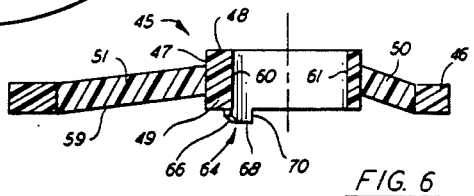
FIG. 6 is a side view in cross section of the touring basket taken along the line VI—VI of FIG. 4.

Three different baskets, separately mountable on the end piece of FIGS. 1–3, are illustrated in FIGS. 4–6, 7–8, and 9–10, respectively. With reference particularly to FIGS. 4–6, a touring basket 45 of molded plastic includes an oval rim 46 provided with a hub 47 having an upper face 48, a lower face 49, and supported by a front spoke 50, a rear spoke 51, left side spokes 52, 53, and 54, and right side spokes 55, 56, and 57. The touring basket 45 is symmetrical with respect to a fore-and-aft plane that includes a center axis of the hub, but the hub is located forward of the center of the oval rim. This design makes it easier to pivot the handle of the pole forward during skiing while maintaining good contact with the surface of the snow.

The oval rim 46 has a flat undersurface 58 and a rectangular cross section, as shown in FIG. 6. Each spoke also has a flat undersurface 59 (see FIG. 5) but preferably a triangular cross section which provides rigidity with minimum weight and also helps to keep from collecting snow on top. This object is also aided by angling the spokes upward from the plane of the rim to the hub, to give the basket a crowned shape, as shown clearly in FIG. 6.

The hub 47 has an inner bore 60 that is adapted to slide easily but fit snugly on the upper cylindrical portion 19 of end piece 11. The inner bore 60 is cut out by two diametrically opposed longitudinal grooves or keyways 61, 62, each having an angular extent sufficient to permit the respective one of keys 25, 26 on end piece 11 to slide axially through the keyway until the flat surface 23 of upper flange 22 abuts against the upper face 48 of the hub.

The axial distance between the upper face 48 and the lower face 49 of the hub is substantially the same as the axial distance between the flat surface 23 of flange 22 and the tops of the sawtooth ramps 33, 34, 35, 36 of keys 25, 26. Extending axially from the lower face 49 of the hub are two diametrically opposed protruberances 63, 64 that are resilient enough to ride up and over the sloping ramp faces of the respective ramps when the touring basket is rotated in the direction toward the sloping faces of the ramps, yet are still stiff enough to matingly fit in the space between the two ramps of each key. To this end, the protruberances 63, 64 have sloping faces 65, 66 that mate with the sloping ramp faces 38, 40 of ramps 34, 36, bottom surfaces 67, 68 that slidingly engage the flat faces 29, 30 of ledges 27, 28, and axial faces 69, 70 that mate with the axially extending walls 41, 43 of ramps 33, 35, respectively, when the protruberances are located between the sawtooth ramps of each key, so as to releasably lock the basket onto the end piece.

Figure 7:
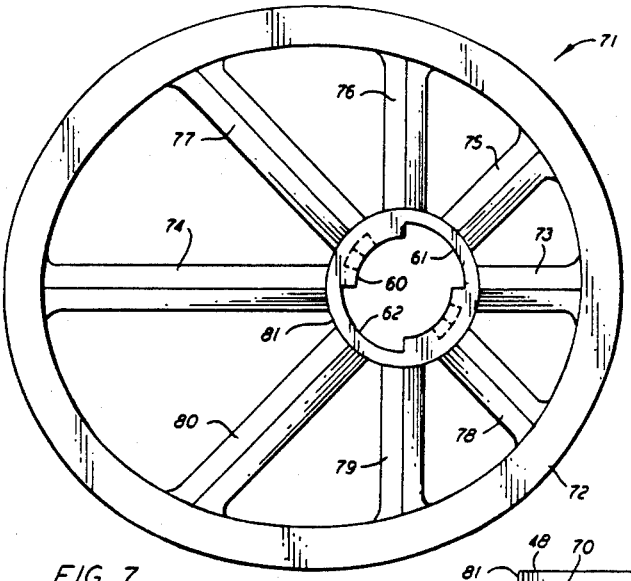
FIG. 7 is a top plan view of a deep powder basket according to the present invention.
Figure 8:
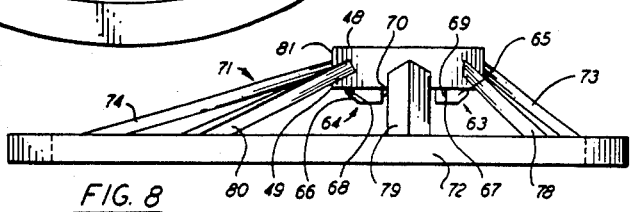
FIG. 8 is a side view of the deep powder basket of FIG. 7.

With reference next to FIGS. 7 and 8, an interchangeable deep powder basket 71 according to the invention is shaped generally like the touring basket 45, but it is almost half again as large and has a more pronounced crown. As with the touring basket, the deep powder basket has an oval rim 72 that carries a front spoke 73, a rear spoke 74, left side spokes 75, 76, 77, and right side spokes 78, 79, 80. The spokes converge upwardly to an off-center hub 81. The shape and dimensions of the hub of the deep powder basket are identical to the shape and dimensions of the hub of the touring basket, and the various elements are identified by the same reference numerals to denote the complete interchangeability of the touring and deep powder baskets.

Figure 9:
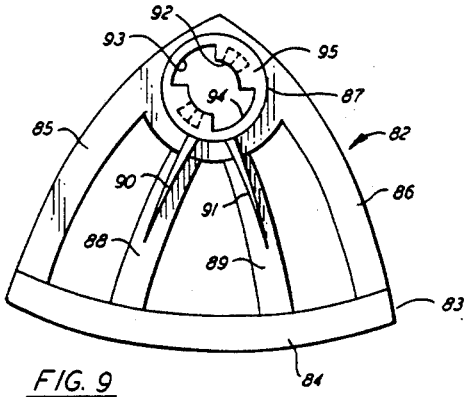
FIG. 9 is a top plan view of a racing basket according to the present invention.
Figure 10:
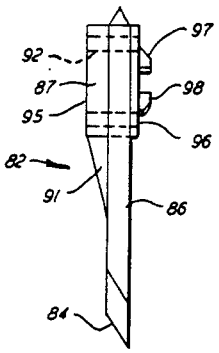
FIG. 10 is a side view of the racing basket of FIG. 9.

The touring basket and the deep powder basket both attach to the upper section of the end piece 11, thus placing them from 2 to 4 inches, and preferably about 3 inches, above the metal tip of the pole assembly. This is optimal placement for these baskets, since it allows the tip to reach down to firmer snow without causing the basket to sink too deeply into the snow. At the same time, it allows the basket to contact the snow surface before the tip engages the ground when skiing on relatively light snow cover. When skiing on hard packed racing tracks, however, one needs only a small basket located 1 to 2 inches from the tip. FIGS. 9 and 10 illustrate a racing basket 82 that has a different shape than the touring and deep powder baskets and is adapted to be attached to the lower section 20 of the end piece.

Racing basket 82 has a rim 83 that is roughly triangular in plan, with a base 84 and sides 85, 86. A hub 87 is located at the apex of the triangle, and two spokes 88, 89 extend from the hub to the base between the sides of the rim. The spokes are stiffened by ribs 90, 91 that also help to reduce snow accumulation on the top of the basket.

The hub 87 of the racing basket has a bore 92 that is sized to fit slidingly on the lower cylindrical section 20 of the end piece 11. The bore has two diametrically opposed longitudinal keyways 93, 94 large enough to pass the keys 25', 26' on the cylindrical lower section 20 of the end piece so that an upper face 95 of the hub can abut against the flat surface 23' of the lower flange 22'. The hub of the racing basket has a lower face 96 from which protruberances 97, 98 extend axially. The shape and function of these protruberances are the same as for protruberances 63, 64 of the touring basket and the deep powder basket, namely, to serve as releasable locking means for engaging the ramps 33', 34' and 35' 36' formed on the cylindrical lower section of the end piece 11.

From the foregoing description, it can be seen that the present invention provides a system of interchangeable baskets for releasably mounting at a preselected plurality of axial positions from the tip of a ski pole. In this way, each type of basket can be located optimally with respect to the tip of the pole. Also, a single set of poles can be quickly and easily converted to use in different conditions and for different skiing activities.

The method of attaching and removing any of the baskets from the pole is simple. To mount a touring basket or a deep powder basket, for example, the metal tip 16 of an end piece 11 is inserted into the bore of the basket from the upper side, followed by the cylindrical lower section 20, and the tapered intermediate section 21. The basket is rotated to line up the keyways 61, 62 with the respective keys 25, 26, and the end piece is inserted further until the upper face 48 of the basket abuts the flat surface 23 of the upper flange 22. This locates the basket at the appropriate axial distance from the tip of the pole. Then, the basket is turned clockwise a quarter turn, causing the protruberences 63, 64 to ride up and over the sloping faces of the ramps 33 and 35 and to snap into locking engagement between adjacent ramps 33, 34 and between adjacent ramps 35, 36, respectively.

To detach the basket from the end piece, it is necessary only to rotate the basket clockwise on the end piece through another quarter turn, causing the protruberances 63, 64 to ride up and over the sloping faces of the ramps 34 and 36 so that keys 25, 26 align with keyways 62, 61, respectively. The basket can then be withdrawn straight from the end piece. The racing basket is mounted in the same way as the touring and deep powder baskets, except that the smaller bore of the racing basket is stopped by the lower flange 22'. Thus, each size of basket is located automatically by the stepped construction of the end piece, at the proper distance from the metal tip 16.

The double-ramp locking means of the preferred embodiment is especially easy to manipulate. Both locking and unlocking are performed by a clockwise quarter-turn. The ratchet action of the locking means is smooth yet positive. The designs of the end piece and the several baskets are well adapted to fabrication by injection molding, and all of these items may be made of the same type of plastic, if desired. The stop flange and double-ramp locking arrangement also are resistant to clogging by snow and ice, so that baskets can be interchanged quickly, even when on the trail. Since the baskets are relatively small, light in weight, and flat, they are easy to carry on the trail. Except for the metal tip, which can be integrally molded as an insert into the end piece, there are no separate parts to become loose or lost.

Although the preferred embodiment of the invention, as illustrated and described, has many important advantages, it will be appreciated that other arrangements of positioning and locking means could be used, while still achieving the principal advantage of providing interchangeable baskets with means for releasably mounting the baskets on a ski pole at different optimal distances from the tip.

We claim:

1. An end piece and basket assembly for a ski pole shaft, the assembly comprising:

a snow-engaging end piece for mounting coaxially at one end of a ski pole shaft, said end piece having a metal tip;

at least one snow-engaging basket for mounting on said end piece, said basket including:

a hub having a bore for receiving said end piece;

a circumferential rim having an under surface for engaging snow; and means joining said rim to said hub;

stop means for fixedly locating said basket on said end piece at a preselected one of a first location and a second location at predetermined different axial distances from said tip; and means for releasably holding said basket in contact with said stop means on said end piece at said preselected one of the first and second axial locations.

2. The assembly of claim 1 wherein:

said end piece is permanently connected to a ski pole shaft.

3. The assembly of claim 1 wherein said means joining said rim to said hub comprises spoke means extending radially inwardly and axially upwardly from said rim to said hub.

4. The assembly of claim 3 wherein said circumferential rim is oval, and said hub is located closer to one end of the oval than to the other end.

5. The assembly of claim 3 wherein said circumferential rim is approximately triangular, and the hub is located adjacent to an apex of the triangle.

6. An end piece and basket assembly for a ski pole shaft, the assembly comprising:

a snow-engaging end piece for mounting coaxially at one end of a ski pole shaft, said end piece having a metal tip;

at least one snow-engaging basket for mounting on said end piece, said basket including:

a hub having a bore for receiving said end piece;

a circumferential rim having an under surface for engaging snow; and means joining said rim to said hub;

means for locating said basket on said end piece at a preselected one of a first location and a second location at predetermined different axial distances from said tip; and means for releasably holding said basket on said end piece at said preselected one of the first and second locations, wherein the means for locating said basket on said end piece comprises a first stop means extending radially outward from the end piece at the first predetermined location, a second stop means extending radially outward from the end piece at the second predetermined location that is spaced axially from said first location, and a surface of said hub that is adapted to abut one of said first and second stop means.

7. The assembly of claim 6 wherein the means for releasably holding said basket on said end piece at said preselected one of the first and second locations comprises:

a radially extending key means on one of the end piece and the basket, an axially extending keyway means in the other of the end piece and the basket, the key means being slidable in the keyway means, and a circumferentially extending surface connected to the keyway means on the other of the end piece and the basket and spaced from the preselected one location for engaging said key means upon rotation of the basket on the end piece with said surface on the hub in abutment with the stop means at said preselected location.

8. The assembly of claim 7 wherein said means for releasably holding said basket on said end piece comprises means for releasably locking the basket against rotation on the end piece when said key means is engaged by said circumferentially extending surface.

9. The assembly of claim 8 wherein the means for releasably locking the basket against rotation on the end piece comprises detent means.

10. The assembly of claim 9 wherein the detent means comprises an axial protruberance extending from said key means and a pair of circumferentially spaced ramp means extending axially from said circumferential surface for engagement by said axial protruberance.

11. An end piece and basket assembly for a ski pole shaft, the assembly comprising:

a snow-engaging end piece for mounting coaxially at one end of a ski pole shaft, said end piece having a metal tip;

at least one snow-engaging basket for mounting on said end piece;

means for locating said basket on said end piece at a preselected one of a first location and a second location at predetermined different axial distances from said tip; and means for releasably holding said basket on said end piece at said preselected one of the first and second locations, wherein the means for locating said basket on said end piece comprises a first stop means extending radially outward from the end piece at the first predetermined axial location, a second stop means extending radially outward from the end piece at the second predetermined axial location, the first location being spaced axially further from said metal tip than the second location, and a surface of said basket that is adapted to abut one of said first and second stop means.

12. The assembly of claim 11 wherein the end piece comprises a first cylindrical section at said first axial location and a second cylindrical section at said second axial location, the diameter of the second cylindrical section being smaller than the diameter of the first cylindrical section, and the basket has a bore adjacent to said surface that is adapted to fit slidingly on the cylindrical section corresponding to said one of the first and second stop means.

13. The assembly of claim 12 wherein the means for releasably holding said basket on said end piece at one of said preselected first and second axial locations comprises:

a radially extending first key means formed on the first cylindrical section of the end piece at a location spaced axially from the first stop means toward the metal tip;

a radially extending second key means formed on the second cylindrical section of the end piece at a location spaced axially from the second stop means toward the metal tip;

an axially extending keyway means formed in the bore of the basket, the key means corresponding to said one of said first and second stop means being slidable in the keyway means; and a circumferentially extending surface connected to the keyway means on the basket and spaced from said surface adapted to abut said one of the first and second stop means so as to engage said key means upon rotation of the basket on the end piece with said surface in abutment with said one of the stop means.

14. The assembly of claim 13 wherein said means for releasably holding said basket on said end piece comprises means for releasably locking the basket against rotation on the end piece when said key means is engaged by said circumferentially extending surface.

15. The assembly of claim 14 wherein the means for releasably locking the basket against rotation on the end piece comprises a pair of circumferentially spaced ramp means extending axially from said key means and a protruberance extending axially from said circumferential surface for engaging said ramp means.

* * * * *